United States Patent [19]

Legters et al.

[11] Patent Number: 4,743,123

[45] Date of Patent: May 10, 1988

[54] PLASTIC BAG AND CLOSED PLASTIC BAG WITH LASER-FORMED VENTING PERFORATIONS

[75] Inventors: Heinrich Legters; Bernhard Lodder, both of Hardenberg, Netherlands

[73] Assignee: Wavin B.V., Netherlands

[21] Appl. No.: 884,887

[22] Filed: Jul. 11, 1986

Related U.S. Application Data

[63] Continuation of Ser. No. 705,029, Feb. 25, 1985, abandoned.

[30] Foreign Application Priority Data

Feb. 24, 1984 [NL] Netherlands ..... 8400578

[51] Int. Cl.[4] ..... B65D 33/01

[52] U.S. Cl. ..... 383/103; 131/281; 219/121 LK; 383/109

[58] Field of Search ..... 383/100, 102, 103, 109; 131/281; 219/121 LK; 204/213

[56] References Cited

U.S. PATENT DOCUMENTS

| | | | |
|---|---|---|---|
| 3,226,527 | 12/1965 | Harding | 219/121 LK |
| 3,546,327 | 12/1970 | Ruda | 383/103 X |
| 3,547,340 | 12/1970 | McDonald | 383/103 X |
| 3,617,702 | 11/1971 | Flournoy | 219/121 LK |
| 3,628,720 | 12/1971 | Lengerich | 383/103 X |
| 3,719,736 | 3/1973 | Woodruff | 383/103 X |
| 4,445,993 | 5/1984 | Stutz et al. | 204/213 |
| 4,672,684 | 6/1987 | Bames et al. | 383/45 |

*Primary Examiner*—Stephen Marcus
*Assistant Examiner*—Bryon Gehman
*Attorney, Agent, or Firm*—Wigman & Cohen

[57] ABSTRACT

A plastic bag of polyolefin material such as polyethylene, for packaging materials, comprising particles of less than 50 μm, and a closed bag containing such materials and a foil material for such a bag.

The foil wall of the bag is provided with venting apertures with smooth edges, obtained by laser radiation, having a maximum size of 50–100 μm; the distance between the venting perforations is such that the tensile strength of the foil is substantially the same as the tensile strength of the similar non-perforated foil.

In a low density polyethylene foil of a thickness of 130–190 μm distance between the perforations of 80 μm is more than 20 mm, in a linear low density polyethylene foil of about 50–110 μm the perforation distance is at least 5 mm.

The bag may consist of two perforated foil layers, the perforations being staggered with respect to each other.

10 Claims, 1 Drawing Sheet

PLASTIC BAG AND CLOSED PLASTIC BAG WITH LASER-FORMED VENTING PERFORATIONS

This is a continuation of co-pending application Ser. No. 705,029 filed on Feb. 25, 1985, now abandoned.

BACKGROUND OF THE INVENTION

The invention relates to a plastic bag of a thermoplastic material for packing loosely poured material comprising venting perforations having a smallest size of at most 150 μm microns in the bag foil wall.

A plastic bag of polyvinylchloride of this type, in which the perforations are obtained by the action of needles on the plastic foil is known in the art. In this known plastic bag the diameter of the perforations is at most 1,000 μm, and preferably 100 to 300 μm, the distance between the individual perforations varies between 14 and 19 mm.

This known plastic bag presents the disadvantage that the perforations formed by the action of needles are generally large in diameter, which means that, particularly during packaging loosely poured materials particularly very fine materials such as cocoa, polyvinylchloride and lime, particles are able to escape to the exterior through the perforations.

Moreover, these perforations have rough edges, so that if the perforations are small in size, they become blocked by the packaged material particles, with the result that the residual air present in such a plastic bag is very slow to leave the bag. This residual air is always present as the materials to be packed are always introduced into the bag by means of a gaseous fluid, mainly air, so that after filling there is always a substantial amount of air between the fine particles of the material in the bag.

This is the reason that until now these plastic bags cannot compete with papers bags for packing these fine materials as said papers bags do not present the above-mentioned disadvantage.

SUMMARY OF THE INVENTION

It is a main object of the invention to provide a plastic bag, with venting perforations in the foil wall of the bag, which is particularly suitable for packaging powdered products such as lime, polyvinyl chloride, cocoa, gypsum, cement and cornflour, and in which the residual air still present after filling of the plastic bag can escape very quickly without taking filling material particles with it, while on the other hand, the uptake of moisture by the filling material in the plastic bag is very small or even absent without substantially weakening the bag or the foil from which the bag is manufactured.

This object is achieved according to the invention by a plastic bag of a thermoplastic material for packing loosely poured material comprising venting perforations having a smallest size of at most 150 μm in the bag foil wall, wherein in a plastic bag of polyolefin material the perforations presenting smooth edges, which have been formed by laser radiation, present a size of at most 150 μm, the distance between the individual perforations being such that the tensile strength of the foil is substantially the same as the tensile strength of such a foil which has not been provided with perforations.

It has been found that in such a plastic bag of polyolefinic material practically no powdered materials are able to pass through the perforations to the exterior and after filling of the plastic bag any air still present had disappeared from the bag after about 1 minute. This latter fact is very surprising as with this combination of perforation diameter and perforation distance such good residual air removal could not be expected.

The plastic bag according to the invention is also particularly good for packaging products from which moisture still escapes after packaging, e.g., sugar.

The plastic bag according to the invention has the great advantage that it is particularly suitable for the packaging of products which until now could be packed only in paper or jute bags, on account of the porous properties of paper and jute.

Preferably the diameter of the perforations is smaller than or substantially equal to the wall thickness of the foil, the wall thickness preferably being comprised between 50 and 250 μm. Advantageously the perforations with smooth edges have a size comprised between 50 and 100 μm, preferably 70 to 90 μm.

With the use of such small perforations, one obtains a plastic bag which is more or less comparable with the paper bags used hitherto for packaging of the above-mentioned materials.

As stated above, the distance between the perforations must be such that the tensile strength of the foil remains essentially the same as the tensile strength of such a foil which has not been provided with perforations.

If perforations with a diameter of about 80 μm are used in a low-density polythylene film with a thickness of 130–190 μm, preferably 160 μm, it is found that the interval between the perforations can be about 25 mm without any reduction in the tensile strength of the film. With intervals of less than 20 mm, the strength decreases rapidly.

This interval is, however, very dependent on the material, since with linear low-density polythene with a thickness of 30 μm the distance between perforations is at least 5 mm the strength of the perforated film is still about the same as that of unperforated film, using perforations with a diameter of 80 μm.

According to a particularly advantageous embodiment, the plastic bag comprises two foil layers both being provided with perforations formed by laser radiation with smooth edges and having a size of most 150 μm, the perforations being at such distances from each other that the tensile strength of the foil is at least equal to the tensile strength of the foil which has not been provided with said perforations. The perforations in the two layers of foil are staggered with respect to each other.

Such a bag presents the great advantage that moisture from the outside has to travel a much greater distance to be able to penetrate into the bag, while after the residual air has gone out of the plastic bag the layers of film can rest against each other, thereby sealing the perforations.

As said above, a plastic bag according to the invention is also particularly suitable for the packaging of materials from which moisture still has to escape after packaging, e.g. sugar. Depending on the quantity of moisture which has to escape from the bag, and depending on the diameter of the perforations, one can easily calculate the number of perforations per unit area which have to be made.

The plastic bag according to the invention is particularly suitable for packaging powder like material comprising particles of less than 50 μm, preferably smaller than 10 μm.

The perforations may be cylindrical, elliptical, or even slit like perforations, provided that their size is at most 150 μm.

Suitable polyolefin materials are polyethylenes and propylenes.

The invention also comprises a closed bag of thermoplastic material filled with a loosely poured material comprising in its foil wall venting perforations having a size of at most 150 μm, wherein the plastic bag of a polyolefin material presents venting perforations formed by laser radiation with smooth edges and having a size of at most 150 μm, said perforations being at such a distance from each other that the tensile strength of the foil is substantially equal to the tensile strength of a foil not being provided with perforations.

Preferably the loosely poured material comprises particles of less than 50 μm, particularly less than 10 μm.

At last the invention also relates to a plastic polyolefin foil material comprising venting perforations with smooth edges and which have been formed by laser radiation, the size of the perforations being at most 150 μm, the distance between the individual perforations being such that tensile strength of the foil is substantially the same as the tensile strength of such a foil which has not been provided with perforations suitable for a plastic bag and a closed plastic bag according to the invention.

DESCRIPTION OF THE PREFERRED EMBODIMENTS

Figure 1:
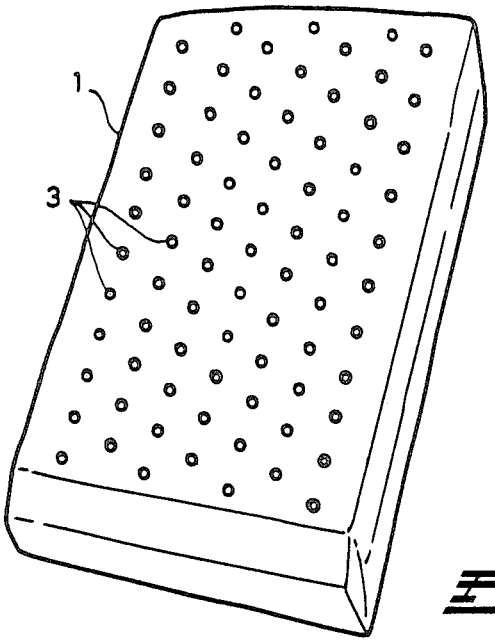
FIG. 1 is a perspective drawing of a plastic bag according to the invention filled with filling materials.

FIG. 1 shows a plastic bag 1, made of low-density polythylene 160 μm thick, in which a (carbon dioxide) laser radiation apparatus has formed perforations 3 with smooth edges and a diameter of about 80 μm.

A diameter of about 80 μm for the perforations is the minimum diameter which can be achieved in practice, although perforations with a diameter of 50 μm can be obtained with very special equipment.

The perforations can be formed at intervals of 25 mm, in which case the strength of the plastic film is essentially the same as that of unperforated film.

With intervals of less than 20 mm, the strength decreases rapidly.

After filling of such a plastic bag through a filling valve (not shown), all the residual air present in the plastic bag can escape in about 1 minute if the bag is filled with cocoa using air as the medium for conveying the filling material into the bag.

Cocoa consists mainly of irregular particles of 7 to 8 μm, cement comprises globules of 2.5 to 10 μm.

In such a filled bag, which contains calcium chloride, gypsum, fertilizer, cement or cornflour, the uptake of moisture in an environment with a humidity of 50% and a temperature of 23° C. was found to be very small, as the materials present in the bag were still very usable after three weeks storage.

The plastic bag shown in FIG. 1 is particularly suitable for the packaging of sugar, from which moisture still has to escape after packaging. This escaping moisture can leave through the perforations in the plastic bag.

The distances between the perforations of about 80 μ m depend greatly on the material, since in a linear low-density polythylene foil of 50–110 μm, preferably 80 μm, with distances of about 5 mm between the perforations the strength of the perforated foil is still equal to that of unperforated film.

Obviously, one strives to increase the number of perforations in the wall to a maximum, in order to obtain good removal of air using perforations of a very small diameter.

Figure 2:
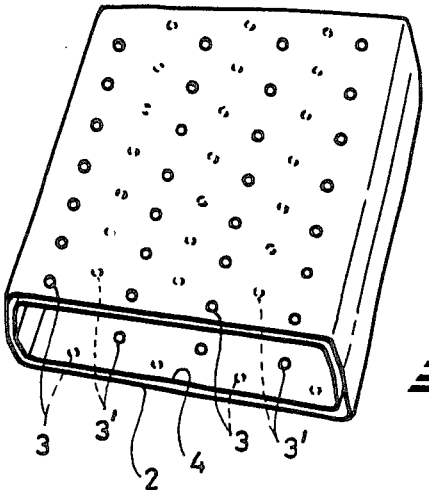
FIG. 2 is a cross section of a plastic bag made up of two foil layers with perforations being staggered with respect to each other.

FIG. 2 shows a plastic bag made of two layers 2, 4 of low density polythylene 160 μm thick, both layers provided with 80 μm perforations spaced 25 mm apart.

The perforations 3 and 3' are staggered, so that these perforation openings can be sealed when the foil layers come into contact with each other after the escape of residual air from the plastic bag. Besides, it is difficult for moisture to penetrate into the plastic bag from the outside and adversely affect the filling material present in it.

In the drawing, the perforations obtained in the top foil layer 2 by means of a laser beam are indicated by reference FIG. 3, while the perforations obtained in the bottom foil layer 4 by means of laser beam are indicated by reference FIG. 3' in the form of dots.

The plastic bag is closed by transverse closing seals, this holds for a valve bag and for an open end bag which open end is closed by a transverse closing seal after filling.

The expression substantially as used hereinbefore means that the tensile strength is 90–100% of the original tensile strength.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A plastic bag of a polyolefin material having a bag foil wall for packing loosely poured material comprising venting perforations having a size of 50 μm to 100 μm in the bag foil wall, wherein the perforations have smooth edges, which have been formed by laser radiation, the diameter of the perforations being less than or substantially equal to the wall thickness of the foil, said foil wall thickness being between 50 and 250 μm, the distance between the individual perforations being at least 5 mm and such that the tensile strength of the foil is substantially the same as the tensile strength of such a foil which has not been provided with perforations, and the loosely poured material to be packed is a powder-like material and comprises particles of less than 50 μm, whereby said powder-like material is unable to pass through said bag perforations.

2. A plastic bag according to claim 1, wherein the plastic bag comprises a polyethylene foil of linear low density polyethylene having a thickness between 50 and 200 μm, preferably 50 to 110 μm.

3. A plastic bag according to claim 1 wherein the loosely poured material to be packed is a powder like material and comprises particles of less than 10 μm.

4. A plastic bag according to claim 1, wherein the perforations with smooth edges have a size between 70 and 90 μm.

5. A plastic bag according to claim 1, wherein the plastic bag comprises a low density polyethylene foil having a thickness between 130 and 190 μm and the distance between the perforations is more than 20 mm.

6. A closed plastic bag of polyolefin material having a bag foil wall filled with a loosely poured material comprising particles of less than 50 μm and having in its bag foil wall venting perforations having a size of 50 μm to 100 μm, wherein the venting perforations are formed by laser radiation with smooth edges and have a size of 50 μm to 100 μm, the diameter of the perforations being less than or substantially equal to the wall thickness of the foil, said foil wall thickness being between 50 and 250 μm, said perforations being at a distance of at least 5 mm from each other and such that the tensile strength of the foil is substantially equal to the tensile strength of a foil not being provided with perforations, whereby said loosely poured material is unable to pass through said bag perforations.

7. A plastic bag according to claim 6 wherein the perforations have a size between 70 and 90 μm.

8. A closed plastic bag according to claim 6, wherein the loosely poured material comprises particles less than 10 μm.

9. A closed plastic bag according to claim 6 wherein the polyethylene foil material is a polyethylene foil of linear low density polyethylene having a thickness of 50 to 200 μm, preferably 50 to 110 μm, the perforation distance being at least 5 mm.

10. A closed plastic bag according to claim 6, wherein the polyethylene foil material is a low density polyethylene foil having a thickness of 130 to 190 μm, and the distance between the perforations is more than 20 mm.

* * * * *